US006836257B2

(12) United States Patent
Louvigne et al.

(10) Patent No.: US 6,836,257 B2
(45) Date of Patent: Dec. 28, 2004

(54) VARIABLE-PITCH HELICAL ANTENNA, AND CORRESPONDING METHOD

(75) Inventors: Jean-Christophe Louvigne, Rennes (FR); Ala Sharaiha, Rennes (FR); Jean-Pierre Blot, La Turbie (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 10/363,518

(22) PCT Filed: Sep. 14, 2001

(86) PCT No.: PCT/FR01/02873

§ 371 (c)(1),
(2), (4) Date: Mar. 3, 2003

(87) PCT Pub. No.: WO02/23673

PCT Pub. Date: Mar. 21, 2002

(65) Prior Publication Data

US 2003/0184496 A1 Oct. 2, 2003

(51) Int. Cl.[7] ..... H01Q 1/36
(52) U.S. Cl. ..... 343/895
(58) Field of Search ..... 343/895, 860, 343/850, 859, 893, 906, 702

(56) References Cited

U.S. PATENT DOCUMENTS 6,232,929 B1 * 5/2001 Ermutlu et al. ..... 343/895
6,396,439 B1 * 5/2002 Hallbjorner ..... 343/895
6,407,720 B1 * 6/2002 Josypenko ..... 343/895
6,587,081 B2 * 7/2003 Noro et al. ..... 343/895
6,608,604 B1 * 8/2003 Sharaiha et al. ..... 343/895

FOREIGN PATENT DOCUMENTS

| | | |
|---|---|---|
| EP | 0 649 181 | 4/1995 |
| EP | 0 920 073 | 6/1999 |
| FR | 2 746 547 | 9/1997 |
| WO | WO 99/60665 | 11/1999 |

OTHER PUBLICATIONS

Luvigne, J. C., and Sharaiha, A., "Synthesis of printed quadrifilar helical antenna," *Electronics Letters*, vol. 37, No. 5, pp. 271–272, Mar. 1, 2001.

* cited by examiner

*Primary Examiner*—Don Wong
*Assistant Examiner*—Minh Dieu
(74) *Attorney, Agent, or Firm*—Kinney & Lange, P.A.

(57) ABSTRACT

A helical antenna includes at least a helix consisting of at least two radiating strands, at least one of the strands consisting of at least two segments, the winding angles of at least two of the segments being different and randomly or pseudo-randomly determined with global optimising means.

16 Claims, 6 Drawing Sheets

VARIABLE-PITCH HELICAL ANTENNA, AND CORRESPONDING METHOD

BACKGROUND OF THE INVENTION

The field of the invention is that of wideband antennas with hemispherical or near-hemispherical radiation patterns. More specifically, the invention relates to helical antennas of this type.

The antenna of the invention is found especially in applications of satellite mobile communications between fixed and/or mobile users of all types, for example aeronautical, maritime or terrestrial communications. In this field, several satellite communications systems are implemented or are now being developed (these include the INMARSAT, INMARSAT-M, GLOBALSTAR, and other systems). These antennas are also valuable in the deployment of personal communications systems (PCS) using geostationary satellites.

The systems are designed to provide terrestrial users with new communications services (multimedia, telephony and other services) through satellites. By means of geostationary or orbiting satellites, they provide global terrestrial coverage. They have to be similar to terrestrial cellular systems in terms of cost, performance a size. Thus, the antenna located in the user's terminal is a key factor in size reduction.

Systems of this kind are described especially in Howard Feldman, D. V. Ramana: <<An introduction to Inmarsat's new mobile multimedia service>>, Sixth International Mobile Satellite Conference, Ottawa, June 1999, and J. V. Evans: <<Satellite systems for personal communications>>, IEEE A-P Magazine, Vol. 39, No. 3, June 1997.

For all these systems, which provide links with geostationary satellites, the very different values of incidence of the signals received or sent require that the antennas should possess a radiation pattern with hemispherical or near-hemispherical coverage. Furthermore, the polarization must be circular (left-hand or right-hand) with a ratio below 5 dB in the useful band.

More generally, the invention can be applied in all systems requiring a small-sized antenna, the use of a very wide band and circular polarization.

In these different fields of application, the antennas must often have the above characteristics either in a very large bandwidth of about 10% or in two neighboring sub-bands corresponding respectively to reception and to transmission. It is also essential that the size and weight should be reduced to the greatest possible extent.

The invention can be applied especially to quadrifilar antennas.

A quadrifilar antenna is formed by four radiating strands. An exemplary quadrifilar antenna is described in detail in A. Sharaiha and C. Terret, "Analysis of quadrifilar resonant helical antenna for mobile communications" (IEE Proceedings H, vol. 140, no 4, August 1993).

According to this embodiment, the radiating strands are printed on a thin dielectric substrate and then wound about an RF-transparent cylindrical support. The four strands of the helix are open or short-circuited at one end and electrically connected at the other end.

This antenna requires a power circuit that excites the different antenna strands by signals having the same amplitude in phase quadrature. This function may be performed by means of structures comprising 3 dB–90° couplers and a hybrid ring. This assembly can be made in printed circuit form and placed at the base of the antennas. Thus, a simple but bulky power supply system is obtained.

As mentioned further above, it is desirable for the antenna (including its supply) to be as small-sized and lightweight as possible.

Several solutions have been proposed to this end.

For the power supply system, a solution has been proposed based on the making of three hybrid couplers designed as semi-localized elements and printed in the prolongation of the antenna. This technique is described especially in the patent FR-96 03698, filed on behalf of the present applicant.

The antenna itself has three known improvements in particular.

A first approach is described by B. Desplanches, A. Sharaiha, C. Terret in <<Parametrical study of printed quadrifilar helical antennas with central dielectric rods>> (Microwave and Opt. Technol. Letters, Vol. 20, No 4, Feb. 20, 1999). This solution of miniaturization augments the permittivity of the cylindrical support around which the substrate is wound.

This technique reduces the height by about 30 percent. It is also very simple to make. However, it has the drawback of reducing the bandwidth. Furthermore, it is costly.

According to a second solution, the height of the antenna may be reduced by cutting each strand into two distinct parts having a length of about $\lambda/4$ with a symmetry with respect to the middle of each strand. This technique is described especially in the article by D. F. Filipovic, M. Ali Tassoudji, E. Ozaki: <<A coupled-segment quadrifilar helical antenna>> (MTT-S Symposium on technologies for wireless applications, Vancouver, Canada, 1997).

Again, this gives a satisfactory reduction in height (by 28.4% in the example given), without any modification in the radiation pattern and the ratio of ellipticity. Furthermore, the structure proves to be simple.

By contrast, the bandwidth is reduced to 3% for a SWR value<2. Furthermore, an antenna of this kind requires difficult adjustments of the coupling between the active strands and the passive strands.

A third proposal for reducing the height of the printed quadrifilar helix (PQH) antenna is to wind each strand of the helix according to a non-linear equation as described in M. E. Ermutlu: <<Modified quadrifilar helix antennas for mobile satellite communication>> (IEEE APS Conference on antennas and propagation for wireless communications, Piscataway, N.J., 1998). This approach can give a size reduction of 14%.

However, this technique introduces a deterioration of the ratio of ellipticity throughout the coverage.

In other words, the known techniques used to reduce the height of the antenna show major defects in terms of characteristics. The operation of reduction leads to the deterioration of the bandwidth and/or of the ratio of ellipticity.

Furthermore, as mentioned further above, it is often desirable to have a large bandwidth and/or bandwidths corresponding to transmission and reception respectively.

The patent FR-89 14952 filed on behalf of the present applicant describes a type of antenna particularly suited to such applications.

This antenna, known as a printed quadrifilar helix (PQH) antenna, possesses characteristics similar to those laid down by the criteria set forth, in a frequency band generally limited to 6% or 8% for an SWR of less than two. A wider band operation can be obtained by using two-layer PQH antennas. These antennas are formed by the concentric "nesting" of two electromagnetically coupled coaxial, resonant quadrifilar helixes. The assembly works like two coupled resonant circuits whose coupling separates the resonant frequencies. Thus, a two-layer, resonant, quadrifilar helix antenna, according to the technique described in FR-89 14952, is obtained.

This technique has the advantage of requiring only one power supply system and of enabling dual-band and wide-band operation.

However, it has the drawback of requiring the manufacture of two printed and nested circuits and of offering only a small bandwidth in each sub-band.

A quadrifilar antenna is formed by four radiating strands. An exemplary embodiment is described in detail in A. Sharaiha and C. Terret, "Analysis of quadrifilar resonant helical antenna for mobile communications," (IEE—Proceedings H, vol. 140, No. 4, August 1993).

According to this embodiment, the radiating strands are printed on a thin dielectric substrate and then wound about an RF-transparent cylindrical support. The four strands of the helix are open or short-circuited at one end and electrically connected at the other end.

This antenna requires a power circuit that excites the different antenna strands by means of signals having the same amplitude in phase quadrature. This function may be performed by means of structures comprising 3 dB–90° couplers and a hybrid ring. This assembly can be made in printed circuit form and placed at the base of the antennas. Thus, a simple but bulky power supply system is obtained.

As mentioned further above, it is desirable that the antenna (including its supply) should be as small-sized and lightweight as possible, and that it should cost as little as possible.

Several solutions have been proposed in order to reduce the dimensions of the antenna and of its power supply system. Among other examples, we may cite for example the solutions presented in the FR-96 03698, filed on behalf of the present applicant and in B. Desplanches, A. Sharaiha, C. Terret, <<Parametrical study of printed quadrifilar helical antennas with central dielectric rods>> (Microwave and Opt. Technol. Letters, Vol. 20, No 4, Feb. 20, 1999).

SUMMARY OF THE INVENTION

The invention is aimed especially at overcoming the different drawbacks of the prior art.

More specifically, it is a goal of the invention to provide a small-sized resonant helix antenna having a very large bandwidth and/or two bandwidths covering the transmission band and the reception band of a communications system.

In particular, it is a goal of the invention to provide a helix antenna of this kind whose size, performance and cost price are adapted (and hence at least similar) to the portable terminals of terrestrial cellular systems. In this approach, the size and the weight of the antenna are crucial aspects.

According to another aspect, it is a goal of the invention to provide a resonant helix antenna having a very large bandwidth and/or two bandwidths covering the transmission band and the reception band of a communications system.

In particular, it is a goal of the invention to provide a helix antenna of this kind having a major bandwidth (greater than the bandwidth obtained in the prior art) in each sub-band, when two sub-bands are planned.

It is another goal of the invention to provide an antenna of this kind whose size, performance and cost price are adapted (and hence at least similar) to the portable terminals of terrestrial cellular systems.

Another goal of the invention is to provide characteristics similar or superior to those of the double-helix antennas (which are more complicated to make) with a single helix.

These goals, as well as others that shall appear here below, are achieved according to the invention by means of a helix antenna comprising at least one helix formed by at least two radiating strands, at least one of said strands of which is formed by at least two segments, the pitch angles of at least two of said segments being different and determined randomly or pseudo-randomly by the global optimization means.

This novel and inventive approach provides for a satisfactory reduction in the size of the antenna (as compared with a classic antenna having strands with a constant pitch angle), the manufacture and cost price remaining identical.

Preferably, said strands are printed on a substrate. This mode of manufacture, which is known per se, is both simple and efficient.

According to an advantageous embodiment of the invention, at least one of said helixes is a quadrifilar helix, comprising four strands.

Preferably, the strands forming a helix all have the same geometrical characteristics. However, in certain particular embodiments, strands that are different from one another may be envisaged.

In general, the segments may have any lengths whatsoever, and these lengths may be identical or different. Similarly, there may be any number of segments per strand, and the pitch angle of each segment may be any angle (from 0° to 90°).

The invention also relates to a method to determine the pitch angles of segments of strands of a helix antenna as described here above. A method of this kind advantageously implements a global optimization step in which pitch angle values are selected by:

(i) randomly or pseudo-randomly determining possible pitch angle values;

(ii) repeating the step (i) so long as said possible pitch angle values cannot be used to obtain a radiation pattern in terms of main and crossed polarization contained in a predetermined template.

This method can be used in particular to implement a global optimization program belonging, for example, to the group comprising simulated annealing and the genetic algorithm.

According to another aspect of the invention, it is advantageously planned that at least one of said segments of at least one of said strands will have a variable width.

The antenna thus obtained has a wider bandwidth (in one or two sub-bands) than the classic antenna with strands of constant width, hereinafter called a reference antenna, without increasing the complexity of manufacture or the cost price.

It must be noted that this aspect of the invention can also be applied to antennas whose strands more conventionally comprise a single segment.

According to an advantageous embodiment of the invention, the width of said segments, or segments of variable width, varies monotonically between a maximum width and a minimum width.

Advantageously, said segments of variable width are such that the width of said segments to which they belong varies monotonically between a maximum width (D1) and a minimum width (D2).

Preferably, the end having said maximum width is connected to a feeder line of a power supply circuit, the end having said minimum width being open.

According to a first embodiment of the invention, the width of said strand or strands of variable width varies regularly.

According to another embodiment, said width may follow a law belonging to the group comprising:

linear laws;

exponential laws;

double exponential laws;

stepped laws.

According to another approach, it can be planned that the width of said strands or said strands of variable width varies non-regularly.

Preferably, the dimensions of said strands are determined so as to provide a large bandwidth greater than 8% (and more generally greater than that of the reference antenna with constant-width strands) for an SWR of less than 2.

According to an advantageous embodiment of the invention, the dimensions of said strands are determined so as to give a double bandwidth.

As already mentioned, the bandwidths of each sub-band are greater than that of the reference antenna.

BRIEF DESCRIPTION OF THE DRAWINGS

Other features and advantages of the invention shall appear more clearly from the following description of a preferred embodiment of the invention, given by way of an illustrative and non-restrictive example, and from the appended drawings of which.

Figure 3:
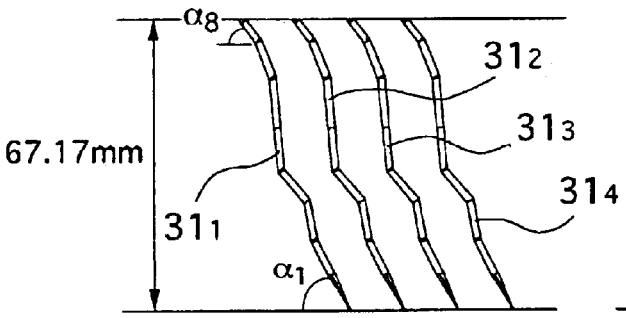
FIG. 3 is an exemplary helix according to the invention, in its unwound form.
Figure 9:
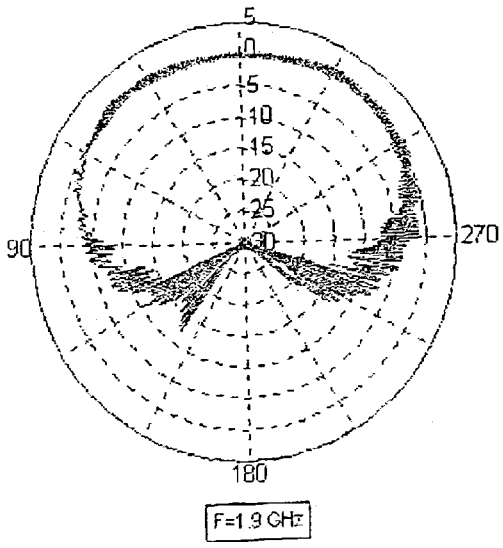
FIGS. 9 to 12 illustrate the radiation patterns measured in rotating polarization (FIGS. 9 and 11) and the ratios of ellipticity (FIGS. 10 and 12) at the following frequencies.
Figure 10:
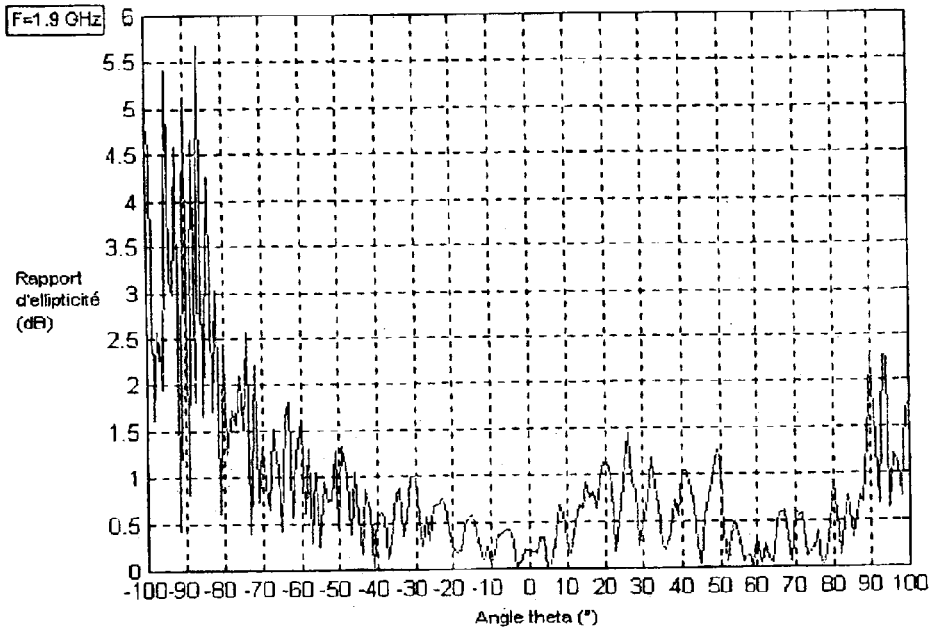
Figure 12:
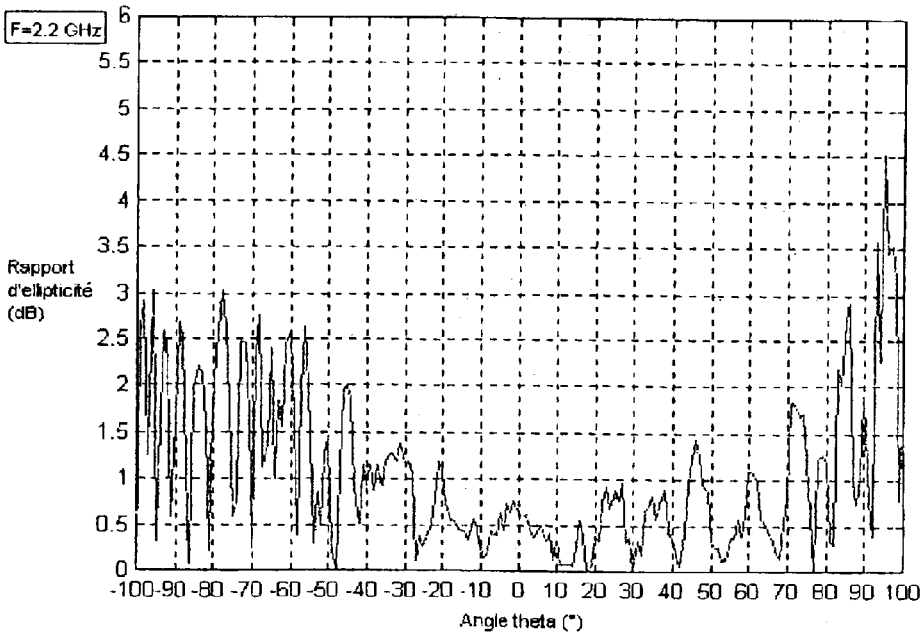
Figure 13:
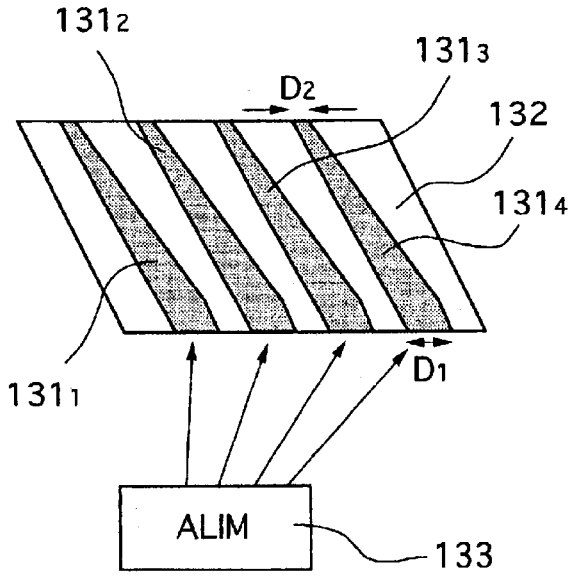
Figure 14:
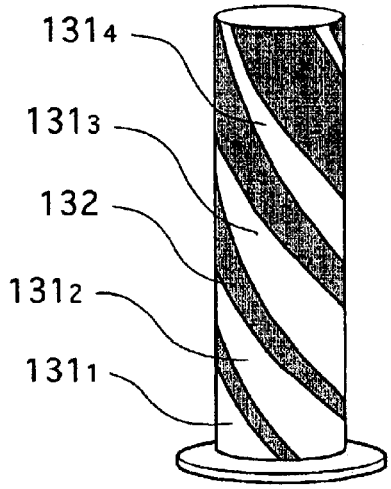
Figure 15:
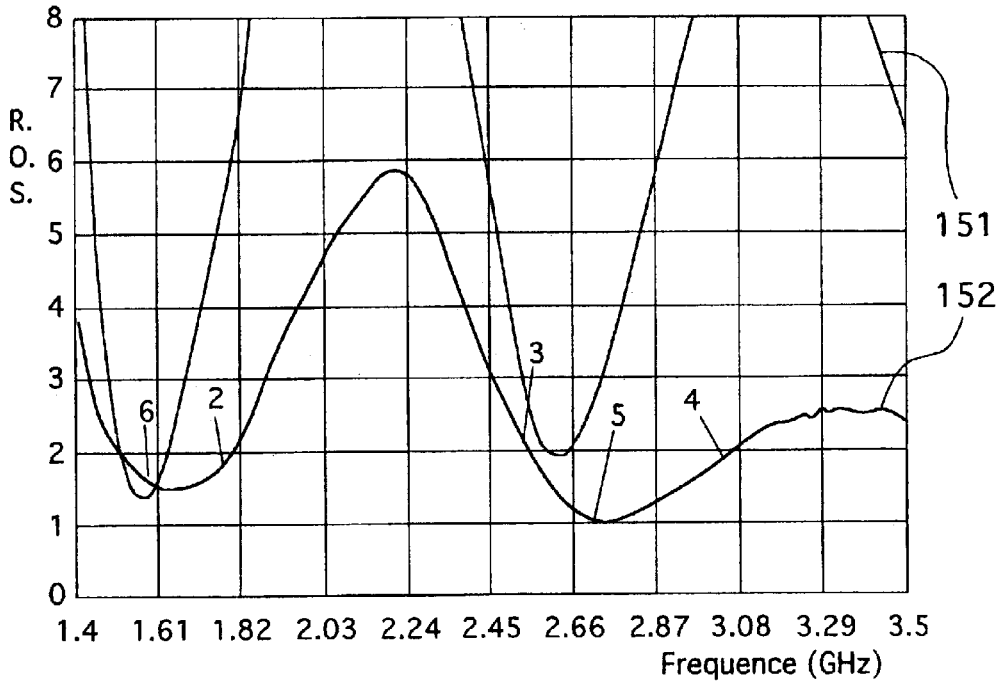
Figure 16A:
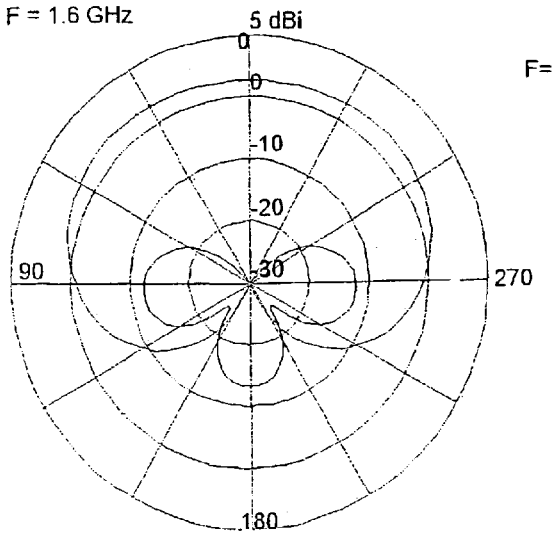
Figure 16B:
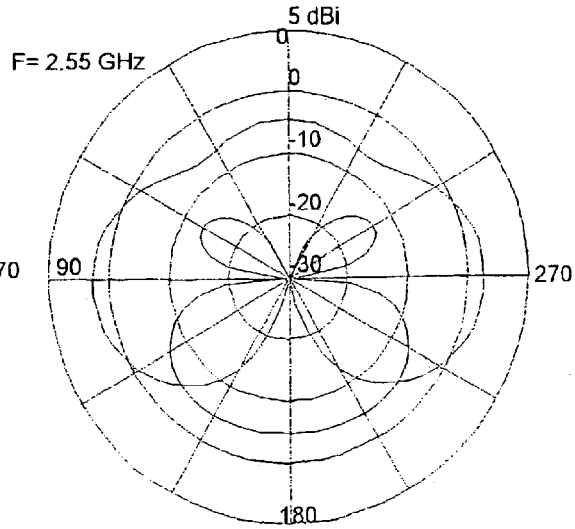
Figure 17A:
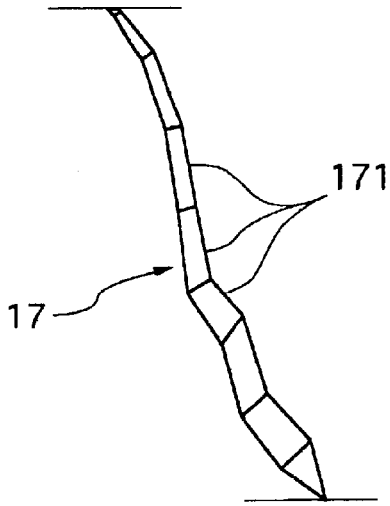
Figure 17B:
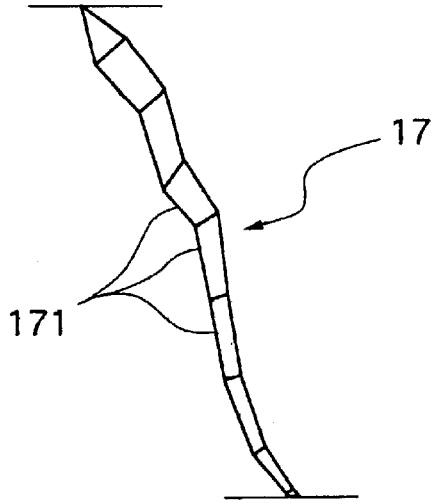

1.9 GHz (FIGS. 9 et 11);

2.2 GHz (FIGS. 10 et 12);

FIG. 13 exemplifies a helix with variable-width strands, in its unwound form;

FIG. 14 shows a front view of the helix of FIG. 13, wound on its cylindrical support;

FIG. 15 exemplifies an SWR measured at the input of a strand for a classic antenna with constant-width strands (shown in a finely dotted line) and for an antenna according to the invention (shown in an unbroken line);

FIGS. 16A and 16B are radiation patterns measured in circular polarization at the frequencies 1.6 GHz (FIG. 6A) and 2.55 GHz (FIG. 6B), for the embodiment corresponding to FIG. 15;

FIGS. 17A and 17B are two exemplary helix strands combining the aspects of FIGS. 3 and 13.

DETAILED DESCRIPTION

Figure 1:
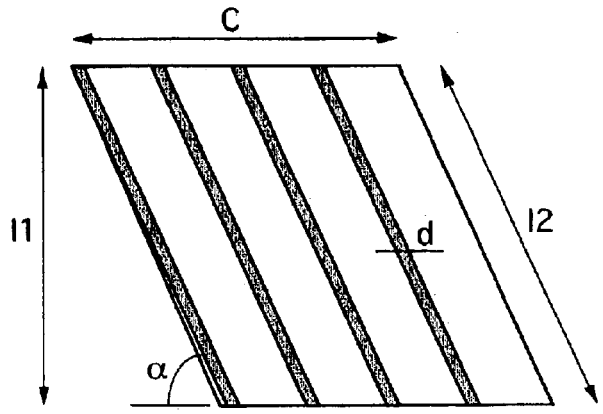
FIGS. 1 and 2 illustrate a known type of quadrifilar helix antenna with classic constant-width strands, respectively when the helix is unwound (FIG. 1) and when it is wound on a cylindrical support (FIG. 2)
Figure 2:
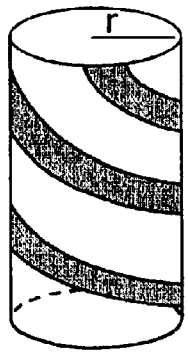

FIGS. 1 and 2 show a classic quadrifilar helix antenna such as the one already discussed in the introduction. This antenna comprises four strands $\mathbf{11}_1$ to $\mathbf{11}_4$ with a length 12 and a width d. These radiating strands are printed on a thin dielectric substrate L2 that is then wound about an RF-transparent cylindrical support 13. This cylindrical support 13 has a radius r, a circumference c and an axial length L1, $\alpha$ being the pitch angle.

Conventionally, the antenna requires a power supply circuit that excites the different strands by means of same-amplitude signals and in phase quadrature. This function may be obtained from 3 dB−90° couplers and a hybrid ring made in printed circuit form and placed at the base of the antennas.

As mentioned here above, the goal of the invention especially is to obtain a PQH antenna working in a wider bandwidth and/or in two sub-bands covering the transmission and reception band of the communications systems.

FIG. 3 shows an exemplary helix according to the invention, in its unwound form. The PQH antenna therefore comprises four conductive strands $\mathbf{31}_1$ to $\mathbf{31}_4$ evenly spaced out and printed on the substrate 32. The four strands are open at one end and connected at the other end to the feeder lines of the power supply circuit 33.

According to the invention, each strand (or at least certain strands) of the PQH is or are subdivided into a limited number of segments. According to the mathematical expressions relating the geometrical parameters of a helix antenna, it is noted that a modification of the pitch angle affects the pitch of the antenna, and therefore its axial length.

Thus, it is possible to give a different pitch angle for each segment. The height may thus be thereby reduced. Setting up different pitch angles may be likened to a change in the pitch of the antenna.

However, the pitch angle $\alpha$ is also a parameter affecting the radiation pattern of a PQH antenna (3 dB aperture angle and ratio of ellipticity). This is why, to choose the different appropriate angles $\alpha$, it is possible to use a global optimization program such as that of simulated annealing presented by Corona, as described for example in http://www.netlib.org/opt/simann.f, or the genetic algorithm presented in Y. Rahmat-Samii, E. Michielssen: "Electromagnetic Optimization by genetic algorithms" (Wiley series in microwave and optical engineering, Wiley-Interscience 1999).

The synthesis is done on the radiation patterns in main and crossed polarization by introducing a template defined by the amplitude levels and the desired −3 dB aperture angles.

By setting up this template, it is possible to perfectly control the −3 dB aperture angles as well as the rejection of the reverse polarization, hence of the ratio of ellipticity. The variables to be optimized are the different pitch angles of the strands of the PQH antenna. The algorithm will give the optimum angles $\alpha_i$.

Naturally, depending on need, different constraints may be taken into account during the optimization.

Thus, a modification of the pitch angles makes it possible firstly to reduce the axial length of the PQH antenna and secondly to obtain the desired ratio of ellipticity and coverage.

We shall now present the measurement results of an exemplary implementation of the invention, corresponding to a prepared model. The optimization pertained to eight different pitch angles and gave a PQH antenna with random variable pitch having the same characteristics as a conventional PQH antenna (constant-pitch antenna).

The pitch angles found randomly are the following:

$\alpha_1=30°$ $\alpha_2=33°$ $\alpha_3=55°$ $\alpha_4=34°$ $\alpha_5=65°$ $\alpha_6=68°$ $\alpha_7=54°$ $\alpha_8=33°$ Thus a PQH antenna with randomly variable pitch is obtained with the following dimensions:

axial length: 67 mm, diameter: 24 mm.

Figure 4:
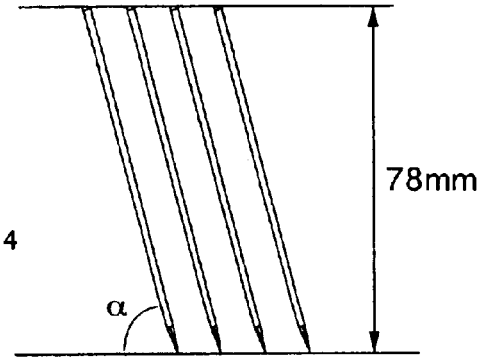
FIG. 4 also gives a view, in its unwound form, of a classic helix having the same characteristics as the helix of FIG. 3

FIG. 3 shows the unwound antenna thus obtained, each strand ($-_1$ to $-_4$) being formed for example by eight segments. As a comparison, FIG. 4 shows a constant-pitch PQH antenna having the same RF characteristics. The pitch angle of this constant-pitch PQH antenna is equal to 54.5°.

The height of this conventional type of antenna is 78 mm. The technique of the invention therefore enables a 14% reduction in the axial length for equal RF characteristics.

Figure 5:
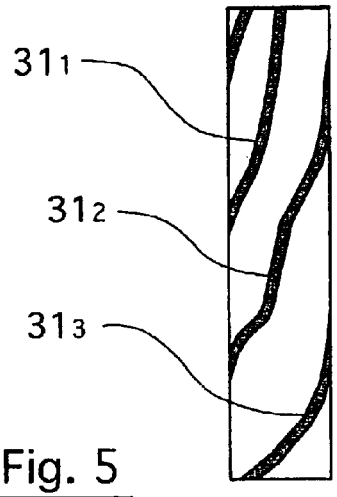
FIG. 5 shows a front view of the helix of FIG. 3, wound on its cylindrical support.

FIG. 5 shows a side view of the antenna of FIG. 3, wound once on its support.

Figure 6:
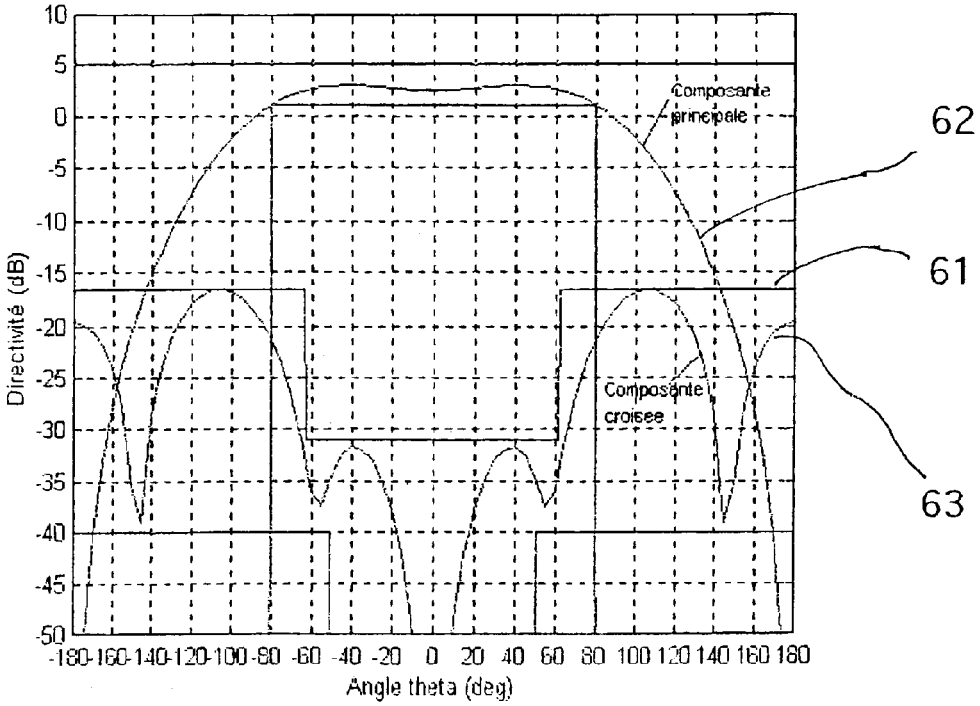
FIG. 6 illustrate the radiation pattern of the antenna of FIG. 5 in circular polarization (main component and crossed component)

FIG. 6 shows the imposed template 61 and the radiation pattern in circular polarization (main component 62 and crossed component 63) obtained with the PQH antenna whose pitch angles have been chosen randomly by a simulated annealing algorithm.

It is noted that the radiation pattern is perfectly included in the imposed template 61.

Figure 7A:
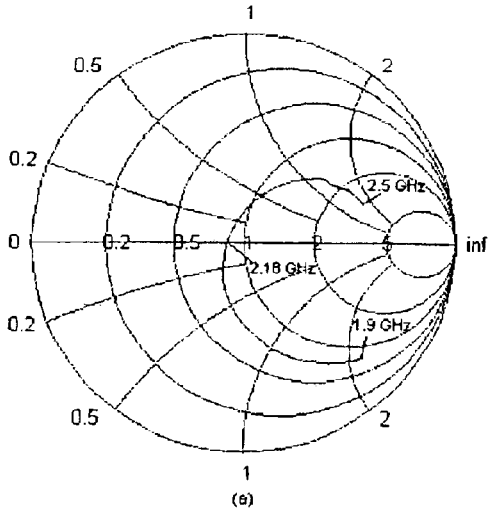
FIGS. 7*a* and 7*b* show the measured input impedance of the antenna of FIG. 5, respectively with respect to a Smith's chart (FIG. 7*a*) and to the SWR (FIG. 7*b*)
Figure 7B:
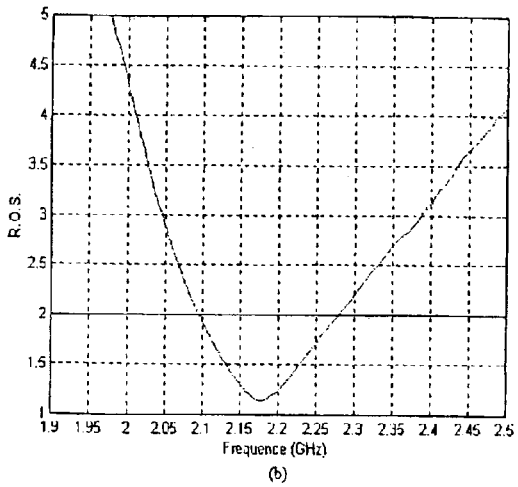

The impedance at the input of a strand (the other three being charged at 50 Ω) and the corresponding SWR are respectively shown in FIGS. 7(*a*) and 7(*b*). A bandwidth of about 8.5% is obtained for an SWR of less than 2. It must be noted that the bandwidth of a classic constant-pitch antenna is of the same order.

Figure 8:
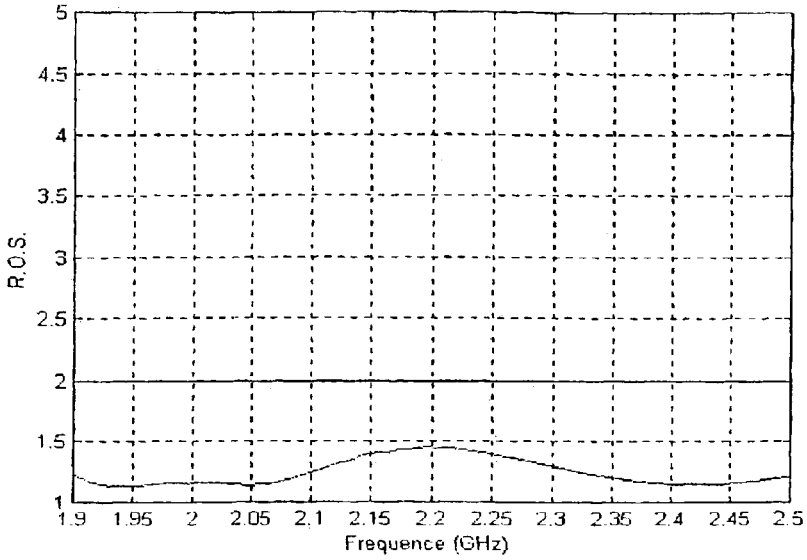
FIG. 8 presents the measured SWR of the antenna of FIG. 5 as a function of the frequency.

FIG. 8 shows the measured SWR of the antenna of the invention with its power supply system as a function of the frequency. It can be noted that, between 1.9 and 2.5 GHz, the SWR remains below 1.5.

Figure 11:
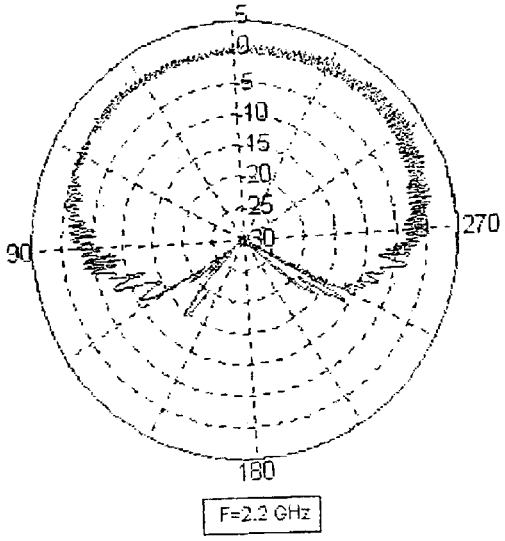

FIGS. 9 to 12 show the radiation patterns measured in rotating polarization and the ratios of ellipticity at the two frequencies 1.9 GHz (FIGS. 9 and 10) and 2.2 GHz (FIGS. 11 et 12).

It can be seen that the ratio of ellipticity remains below 5 dB for $\theta=\pm 90°$ and below 2 dB for $\theta=\pm 70°$.

The invention proposes a solution to reduce the dimensions of the PQH antenna without lowering its RF performances characteristics, by a random modification of the pitch of the antenna. Thus, a new randomly-variable pitch PQH antenna is obtained.

The technique of the invention therefore gives a considerable increase in the bandwidth. Thus, a printed, quadrifilar helix antenna is obtained, working in a large bandwidth and in two different sub-bands with a large bandwidth, whose height is reduced. The variation in the width of the strands therefore increases the bandwidth of the antenna without reducing the lengths of the strands.

Many variants of this embodiment can be envisaged. In particular, the number, length, width and pitch angles of the segments may have any value (given that only some combinations are efficacious).

Furthermore, the invention can be applied to any type of helix antenna, and not only to quadrifilar antennas.

It can also be envisaged that the strands do not always have identical dimensions.

According to the embodiment described, the antenna is printed flat and then wound on a support to form the antenna. According to another, even faster embodiment, the substrate designed to receive the printed elements can be made directly in its definitive, cylindrical form. In this case, the strands and the power feed structure are printed directly on the cylinder.

Furthermore it must be noted that, although it can be used by the unit, the antenna of the invention can also be used to make antenna arrays.

It is also possible to mount two (or more) antennas of this type coaxially and concentrically.

Finally, the technique of the invention is compatible with techniques designed to broaden the bandwidth or bandwidths, as described here below in particular. In this case, the variation in width can be applied to all the segments or selectively to certain segments.

FIG. 13 shows an exemplary helix with a variable strand width, according to one aspect of the invention, in its unwound form. The PQH antenna therefore has four evenly spaced out conductive strands $\mathbf{131}_1$ to $\mathbf{131}_4$ printed on the substrate 132. The four strands are open at one end having a width D2 and connected at the other end, having a width D1, to the power supply lines of the power supply circuit 133.

The variation in the width of the strands D1 to D2 may be regular as indicated in the figure or not regular. The antenna is then wound around a cylindrical support, as shown in FIG. 14, which shows a front face of the antenna wound on its cylindrical support.

A detailed description shall now be given of a particular embodiment of this aspect of the invention. Naturally, this is only a simple example, and many variants and adaptations are possible, depending on needs and applications.

The antenna made has the following characteristics:

Length of the strands: 120 mm

Diameter: 28 mm

Pitch angle: 54.5°

D1: 16 mm

D2: 2 mm

FIG. 15 enables a comparison to be made between the SWR measured as a function of the input of a strand for a PQH antenna with constant strand width (151) and variable strand width (152). The antennas are measured at the center frequency F1=1.6 GHz and have a second resonance for F2=2.55 GHz for two-band operation.

It can be seen that, for the PQH antenna with variable strand width of the inventor, a significant increase is obtained in the bandwidth. Indeed, there is a passage (for an SWR<2) from 8% to 16% at F1 and from 3% to 16% at F2.

The following FIGS. 16A and 16B show the radiation patterns measured in circular polarization respectively at the two frequencies 1.6 GHz and 2.55 GHz, for the helix of the invention.

It can be seen therefore that the antenna of the invention makes it possible to obtain:

Efficient rejection of the reverse polarization (Ed) in a wide coverage;

An almost hemispherical coverage with a maximum in the axis in the band of F1;

a maximum at 90° with a −6 dB dip between −45°<0<45° in the band of F2.

The technique of the invention therefore gives a considerable increase in the bandwidth. Thus, a printed, quadrifilar helix antenna is obtained. This antenna works in a large bandwidth and in two different bands with a large bandwidth whose height is limited. The variation of the width of the strands therefore increases the bandwidth of the antenna without reducing the lengths of the strands.

Many variants of this embodiment can be envisaged. In particular, it must be recalled, that the variation in width can be regular according to a linear, exponential, double exponential, stepped or other law, or it can be non-regular.

It can also be envisaged that the strands do not all have identical dimensions.

According to the embodiment described, the antenna is printed flat and then wound on a support to form the antenna. According to another embodiment implemented even more quickly, the substrate designed to receive the printed elements may be made directly in its definitive cylindrical form. In this case, the strands and the power feed structure are printed directly on the cylinder.

It must also be noted that, although it can be used as a single antenna, the antenna of the invention can also be used to make antenna arrays.

It is also possible to coaxially or concentrically mount two (or more) antennas of this type.

As mentioned further above, this approach can be applied to strands formed by several segments as illustrated for example in FIG. 3. In this case, the variation in width may be applied to all the segments or, selectively, to some of them.

FIGS. 17*a* and 17*b* illustrate two examples of a strand of an antenna such as this. It is noted that, in these examples, the total width of the strand 17 is respectively decreasing (17A) and increasing (FIG. 17B), each segment 171 itself having a decreasing width (FIG. 17A) and increasing width (FIG. 17B) The same observations (on geometry, law of variation of width, etc.) applied here above to the strands may be applied also to each of the segments and/or to the entire strand formed by several segments.

What is claimed is:

1. Helix antenna comprising at least one helix formed by at least two radiating strands, characterized in that at least one of said strands is formed by at least two segments, the pitch angles of at least two of said segments being different and determined randomly or pseudo-randomly by the global optimization means.

2. Helix antenna according to claim 1, characterized in that said strands are printed on a substrate.

3. Helix antenna according to claim 1, characterized in that at least one of said helixes is a quadrifilar helix, comprising four strands.

4. Helix antenna according to claim 1, characterized in that the strands forming a helix all have the same geometrical characteristics.

5. Helix antenna according to claim 1, characterized in that at least one of said segments of at least one of said strands has a variable width.

6. Helix antenna according to claim 1, characterized in that the width of said segment or segments of variable width varies monotonically between a maximum width and a minimum width.

7. Helix antenna according to claim 5, characterized in that said segments of variable width are such that the width of said segments to which they belong varies monotonically between a maximum width and a minimum width.

8. Helix antenna according to claim 7, characterized in that the end having said maximum width is connected to a feeder line of a power supply circuit, the end with said minimum width being open.

9. Helix antenna according to claim 5, characterized in that the width of said strand or strands of variable width varies regularly.

10. Helix antenna accordingly to claim 9, characterized in that said width follows a law belonging to the group comprising:

linear laws;

exponential laws;

double exponential laws;

stepped laws.

11. Helix antenna according to claim 5, characterized in that the width of said strands or said strands of variable width varies non-regularly.

12. Helix antenna according to claim 1, characterized in that the dimensions of said strands are determined so as to provide a large bandwidth greater than 8% for an SWR of less than 2 (and more generally greater than that of the reference antenna with constant-width strands).

13. Helix antenna according to claim 1, characterized in that the dimensions of said strands are determined so as to give a double bandwidth.

14. Method to determine the pitch angles of segments of strands of a helix antenna, characterized in that it implements a global optimization step in which pitch angle values of at, least two of the segments are different and are selected by: (i) randomly or pseudo-randomly determining possible pitch angle values; and (ii) repeating the step (i) so long as said possible pitch angle values cannot be used to obtain a radiation pattern in terms of main and crossed polarization contained in a predetermined template.

15. Method to determine the pitch angles according to claim 14, characterized in that it implements a global optimization program.

16. Method to determine the pitch angles according to claim 15, characterized in that said global optimization program belongs to the group comprising simulated annealing and the genetic algorithm.

* * * * *